US009700109B2

(12) United States Patent
Gordin

(10) Patent No.: US 9,700,109 B2
(45) Date of Patent: Jul. 11, 2017

(54) MOBILITY DEVICE

(71) Applicant: Vadim Gordin, Louisville, KY (US)

(72) Inventor: Vadim Gordin, Louisville, KY (US)

( * ) Notice: Subject to any disclaimer, the term of this patent is extended or adjusted under 35 U.S.C. 154(b) by 0 days.

(21) Appl. No.: 14/988,737

(22) Filed: Jan. 5, 2016

(65) Prior Publication Data

US 2016/0192746 A1 Jul. 7, 2016

Related U.S. Application Data

(60) Provisional application No. 62/110,504, filed on Jan. 31, 2015, provisional application No. 62/100,035, filed on Jan. 5, 2015, provisional application No. 62/156,993, filed on May 5, 2015, provisional application No. 62/104,790, filed on Jan. 18, 2015.

(51) Int. Cl.

| | |
|---|---|
| ***A45B 1/04*** | (2006.01) |
| ***A61H 3/04*** | (2006.01) |
| *A45B 9/02* | (2006.01) |
| *A61H 3/02* | (2006.01) |

(52) U.S. Cl.

CPC ..... *A45B 1/04* (2013.01); *A61H 3/02* (2013.01); *A61H 3/04* (2013.01); *A45B 9/02* (2013.01); *A61H 2003/0255* (2013.01); *A61H 2201/0119* (2013.01); *A61H 2201/1638* (2013.01)

(58) Field of Classification Search

CPC .... A45B 3/00; A45B 1/04; A45B 9/02; A61H 2003/0255

USPC ..... 135/72, 76; 296/1.02

See application file for complete search history.

(56) References Cited

U.S. PATENT DOCUMENTS

| | | | | |
|---|---|---|---|---|
| 786,755 | A * | 4/1905 | Grey | A45B 3/00 135/66 |
| 4,626,016 | A | 12/1986 | Bergsten | |
| 5,913,562 | A | 6/1999 | Mattarella | |
| 6,340,189 | B1 * | 1/2002 | Pordy | B60N 3/023 16/110.1 |
| 6,488,042 | B2 * | 12/2002 | Troyer | A45B 1/00 135/65 |
| 6,584,643 | B1 * | 7/2003 | Tomaiuolo | B60N 3/026 16/110.1 |
| 7,374,216 | B2 * | 5/2008 | Rousey | A45B 3/00 294/209 |
| 7,445,016 | B1 * | 11/2008 | Ortiz | A45B 9/02 135/65 |
| 7,509,966 | B2 * | 3/2009 | Karasin | A61H 3/00 135/66 |
| 7,984,723 | B2 * | 7/2011 | Seivert | A45B 1/00 135/65 |
| 9,296,323 | B2 * | 3/2016 | Voisin | B60N 3/026 |
| 9,403,466 | B1 * | 8/2016 | Deng | B60N 3/023 |
| 2005/0133078 | A1 * | 6/2005 | Fujitsubo | B60N 3/026 135/72 |
| 2009/0044847 | A1 * | 2/2009 | Barangan | A45B 9/02 135/72 |

* cited by examiner

*Primary Examiner* — Noah Chandler Hawk

(57) ABSTRACT

Devices and systems are disclosed which allow a user easier transfer from a seated position into a standing position, particularly those that are adapted to be usable as conventional canes and crutches when not employed for rising from a seat. Seated positions in which the present devices are applicable include at least seated positions in a car, on a commode, and in a bed.

14 Claims, 24 Drawing Sheets

MOBILITY DEVICE

CLAIM OF PRIORITY

This application claims priority to provisional patent application No. 62/100,035 filed Jan. 5, 2015 and titled "Mobility Device" with which it shares inventorship and is incorporated by reference herein in its entirety. Further, this application also claims priority to provisional patent application No. 62/104,790 filed Jan. 18, 2015, 62/110,504 filed Jan. 31, 2015 and 62/156,993 filed on May 5, 2015 all three of which are hereby incorporated by reference in their entirety.

BACKGROUND/FIELD

Canes are used by many people to help with the act of walking. Many of those same cane users have difficulty rising up and out from a seated position in a car. Improved canes are disclosed herein which are configured to help a user rise up from a seated position inside a car to a standing position outside the car. These devices are also useable for rising up from other seated positions including from couches, chairs, commodes, and beds.

SUMMARY

According to certain embodiments of the present disclosure, a mobility device includes; a primary mobility device selected from one of a cane or crutch with the primary mobility device having at least a first grip intended to be grasped by the hand of a user, an engagement tooth coupled to the primary mobility device with the tooth being sized and shaped to be engaged upon the metal loop of an automobile striker plate.

According to further embodiments of the present disclosure, there is a secondary grip coupled to the primary mobility device sized and shaped to be grasped by the hand of a user extending at an angle theta between 15 and 45 degrees between the respective long axes of the first grip and the secondary grip.

According to further embodiments of the present disclosure, the secondary grip extends outward from an elongated shaft of the primary mobility device.

According to further embodiments of the present disclosure, the secondary grip extends outward from the first grip.

According to further embodiments of the present disclosure, the tooth extends in a substantially caudal direction from the secondary grip.

According to further embodiments of the present disclosure, there is a secondary grip extending from the primary grip which is angled relative to the primary grip so that the secondary grip will be substantially parallel to the ground when the tooth is engaged in the door striker of an average height automobile.

According to further embodiments of the present disclosure, the tooth extends in a substantially caudal direction from the primary grip.

According to further embodiments of the present disclosure, the tooth extends in a substantially caudal direction from the secondary grip.

According to further embodiments of the present disclosure, the coupling between the engagement tooth and the primary mobility device is rigid.

According to further embodiments of the present disclosure, the coupling between the engagement tooth and the primary mobility device is capable of pivoting.

According to further embodiments of the present disclosure, the engagement tooth is oriented at an angle theta between 30 and 120 degrees from the long axis of the shaft of the cane or crutch.

According to further embodiments of the present disclosure, there are two mirrored engagement teeth wherein they are mirrored about a plane that intersects the shaft of the cane or crutch.

According to further embodiments of the present disclosure, the angle of the shaft of the mobility device relative to the grip and the tooth may be temporarily changed by means of a separation joint mediated by one of an elastic cord or a hinging pivot.

According to further embodiments of the present disclosure, the tooth extends in a substantially caudal direction from the grip.

BRIEF DESCRIPTION OF THE FIGURES

In the figures, which are not necessarily drawn to scale, like numerals describe substantially similar components throughout the several views. The drawings illustrate generally, by way of example, but not by way of limitation, various embodiments discussed in the claims of the present document.

DETAILED DESCRIPTION OF THE FIGURES

Figure 1:
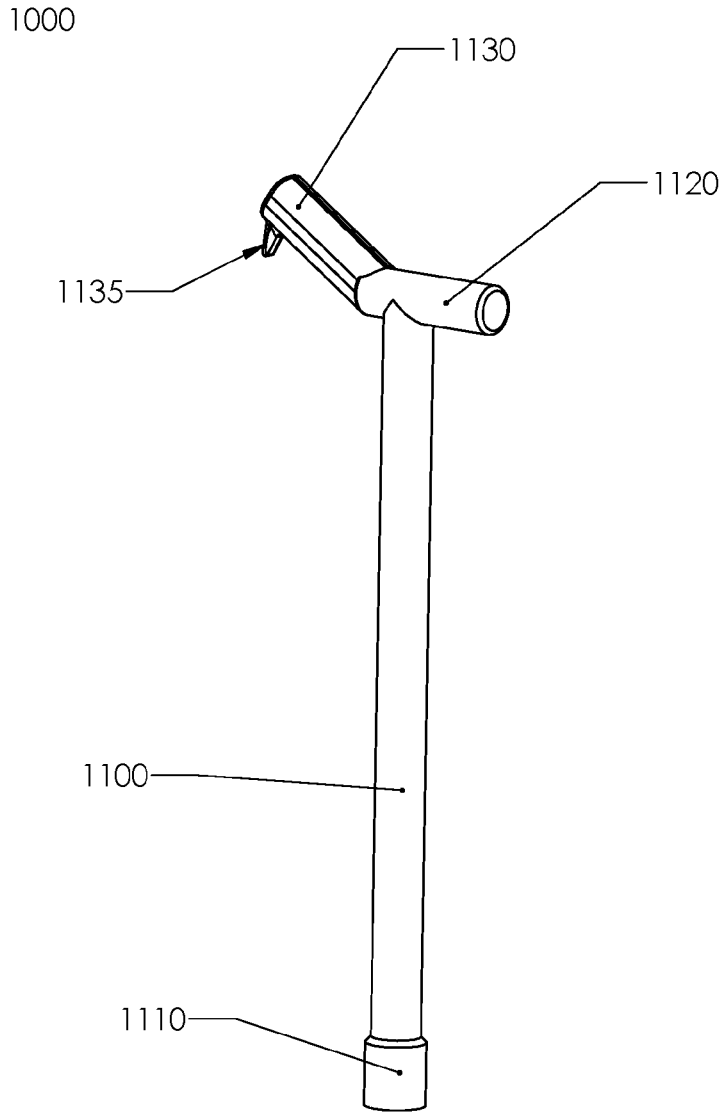
FIG. 1 shows a perspective view of a mobility grip.

Various embodiments of the presently disclosed apparatus will now be described in detail with reference to the drawings, wherein like reference numerals identify similar or identical elements. In the drawings and in the description that follows, the term "proximal," will refer to the end of a device or system that is closest to the operator, while the term "distal" will refer to the end of the device or system that is farthest from the operator. Similar, anatomical terms of reference such as dorsal, lateral, anterior, and sagittal shall have their accepted meanings in the arts.

Referring now to FIG. 1, a mobility device 1000 is shown, with the mobility device being an improved cane, the cane having an elongated shaft 1100 with a cane tip 1110 at the caudal end portion thereof. There is a primary grip 1120 disposed near the cephalic end of shaft 1100 with primary grip 1120 being sized and shaped to be comfortably grasped by the hand of a user. There is a secondary grip 1130 extending at an angle theta from the primary grip 1130. Theta is within the range of 15 to 45 degrees and calculated as the angle between the respective long axises of primary grip 1120 and secondary grip 1130.

There is an engagement tooth 1135 extending outward from secondary grip 1130 with tooth 1135 being sized and shaped to engage removably with the metal loop of an automobile striker plate. Example shapes and configurations of tooth 1135 are disclosed at least by FIG. 2, FIG. 8, FIG. 9, FIG. 9*a*, FIG. 10, and the text of U.S. Pat. No. 6,340,189 granted on Jan. 22, 2002 to William Pordy which is hereby incorporated by reference in its entirety.

Although secondary grip 1130 is shown in the figures as extending in a direction that would approximate a ventral orientation from a user who is standing and grasping primary grip 1120, there are further embodiments of the present disclosure not shown in the figures wherein the secondary grip extends in a substantially dorsal direction relative to a user standing and grasping primary grip 1120.

Although secondary grip 1130 is shown in the figures as extending outward from primary grip 1120, there are further embodiments of the present disclosure wherein the "secondary grip" which is intended to be grasped when the "tooth" is engaged upon an automobile striker plate extends from shaft 1100 rather than primary grip 1120.

Figure 2A:
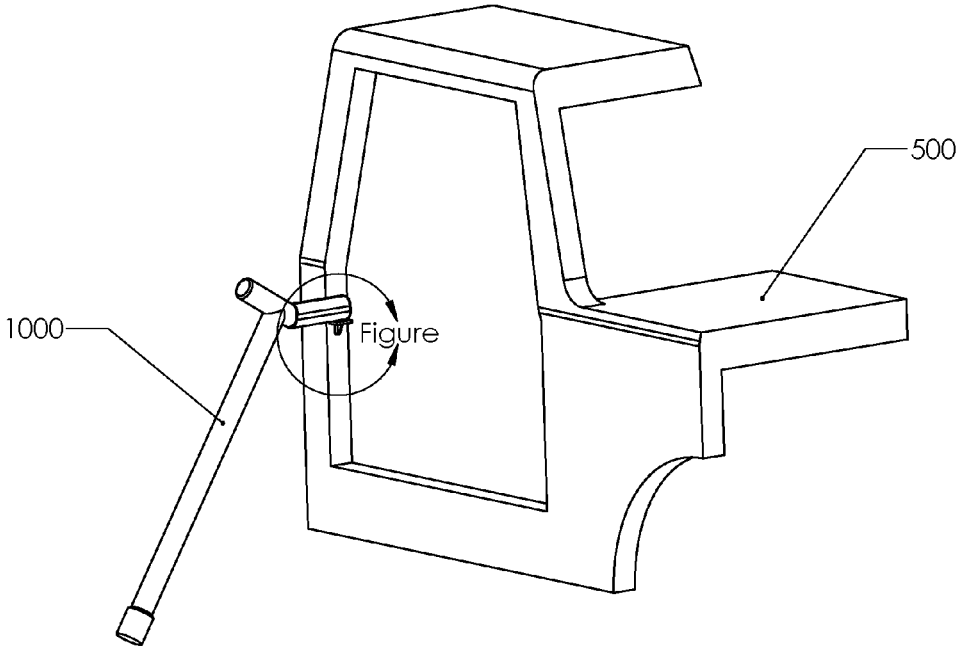
FIG. 2*a* shows a perspective view of a mobility grip engaged upon the door striker plate of an automobile.
Figure 2B:
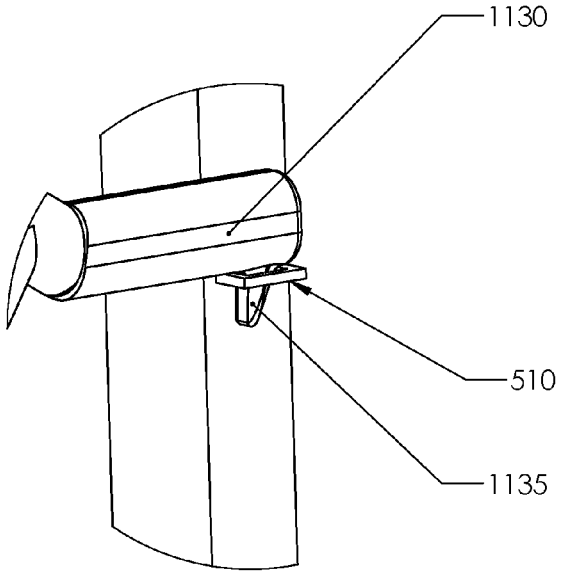
FIG. 2*b* shows an enlarged view of a portion of FIG. 2*a*.

Referring now to FIGS. 2*a* and 2*b* together, a mobility device 1000 is shown engaged to the door striker plate 510 of an automobile 500. In such a configuration, tooth 1135 rests within the metal loop 510 of a striker plate of an automobile 500 while cane tip 1110 is able to fall downward and rest upon the ground. Tooth 1135 is able to pivot within metal loop 510 of the striker plate. Its movement within the striker plate is arrested when cane tip 1110 contacts the ground. Secondary grip 1130 thereby provides a grasping point which a user may hold and push off from to aide in egress from an automobile. When the user desires to remove the mobility device 1000 from the striker plate, it can be lifted up relative to the striker plate, thereby disengaging the mobility device from the automobile and allowing the mobility device to be used as a conventional cane.

The various components of the presently disclosed mobility device may be fabricated from polymers, wood, metal or plastic as would be deemed suitable by one reasonable skilled in the mechanical engineering arts. In one exemplary embodiment, the cane tip 1110 is fabricated from a migh durometer polyurethane, the shaft 1100 is fabricated from aluminum, the tooth 1135 is fabricated from cast stainless steel, and the primary and secondary grips 1120 and 1130 are fabricated from a santoprene or nylon overmolded around the tooth 1135.

Figure 3:
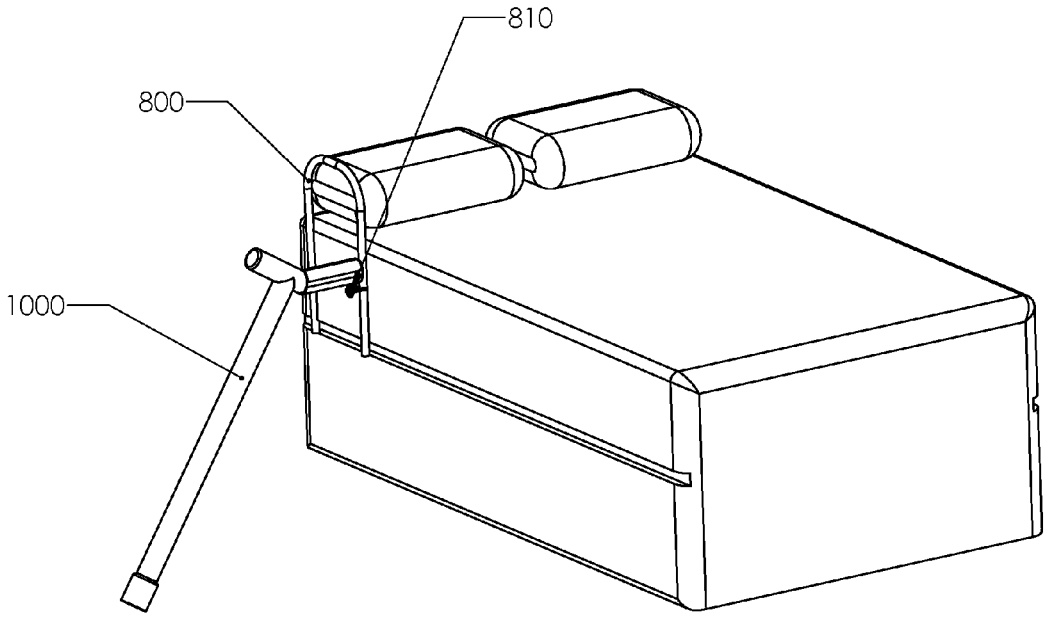
FIG. 3 shows a perspective view of a mobility grip engaged upon a bed rail.

Referring now to FIG. 3, a bed rail 800 is shown engaged to a mattress and box spring. Bed rail 800 has a complementary coupler 810 disposed thereupon sized and shaped to be engaged upon by tooth 1135 of a mobility grip 1000. In such an arrangement, the body of the mobility grip provides a handhold upon which a user can brace themselves when moving from a seated position at the edge of the bed to a standing position. When the user wants to remove the tooth from the coupler 810, he can lift the mobility grip relative to the bed rail and proceed to use the mobility device as a conventional cane.

There are "other structures" such as the bed rail in the preceding paragraph contemplated by the present disclosure which can be modified in the manner described by the preceding paragraph include furniture and durable medical equipment to which a complementary coupler for engagement with the mobility grip 1000 can be attached to provide a handhold for a user. These other structures include bed rails including for instance U.S. Pat. No. 7,032,265 to Miller which is incorporated by reference in its entirety, recliners including for instance U.S. Pat. No. 5,895,093 to Casey et. al. which is incorporated by reference herein in its entirety, commode seats including for instance U.S. Pat. No. 6,857,138 to Moser et. al. which is incorporated by reference in its entirety, dining chairs including for instance U.S. Pat. No. D253924 which is incorporated by reference in its entirety, couch handles including for instance U.S. Pat. No. 7,234,182 to Miller et. al. which is incorporated by reference in its entirety, as well as other articles of furniture or medical equipment known in the arts which a user may occupy in a seated position from which they may desire to arise.

Figure 4:
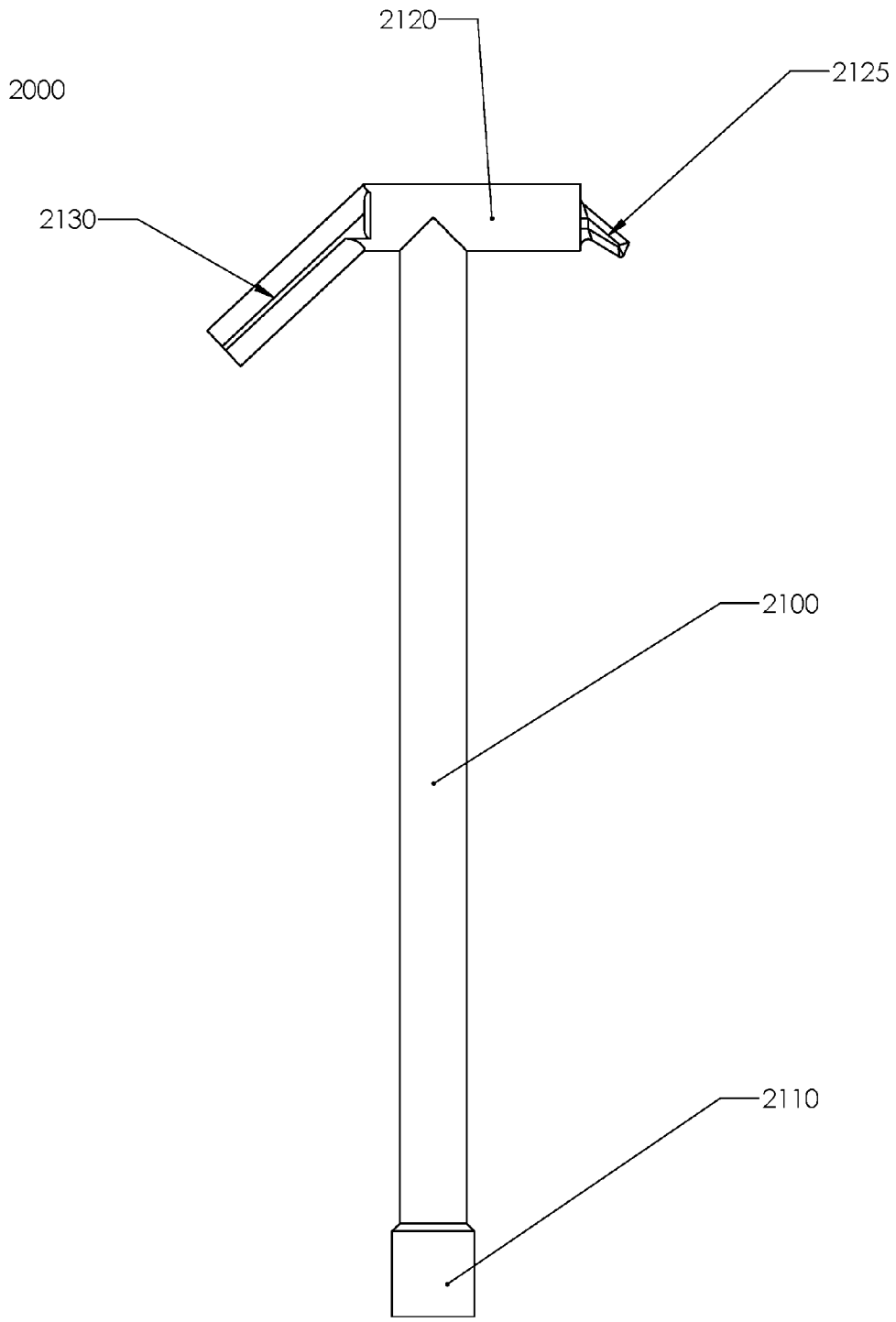
FIG. 4 shows a front view of a further embodiment of a mobility grip.

Referring now to FIG. 4, a further embodiment 2000 of a mobility device is shown. Moblity device 2000 is an improved walking cane similar to mobility device 1000 in that mobility device 2000 has a gripping portion 2120 disposed upon the cephalic-end portion of an elongated shaft 2100. There is a Contact pad 2110 disposed upon the caudal end portion of shaft 2100 selected from a material which provides grip and traction as pad 2110 is pressed against the ground/floor. There is an engagement tooth 2125 sized and shaped to be engaged upon the striker plate of an automobile door extending outward and caudally from primary grip 2120 and a secondary grip 2130 extending from distal end portion of primary grip 2120. The long axis of secondary grip 2130 is disposed at an angle between 15 and 75 degrees downward from the long axis of primary grip 2120.

If a user were shown in FIG. 4 holding mobility device 2000, the user would be facing towards the left edge of the page with their hand engaged about grip 2120 with tooth 2125 extending in a proximal direction towards the user and grip 2130 extending in a distal direction away from the user.

Figure 6:
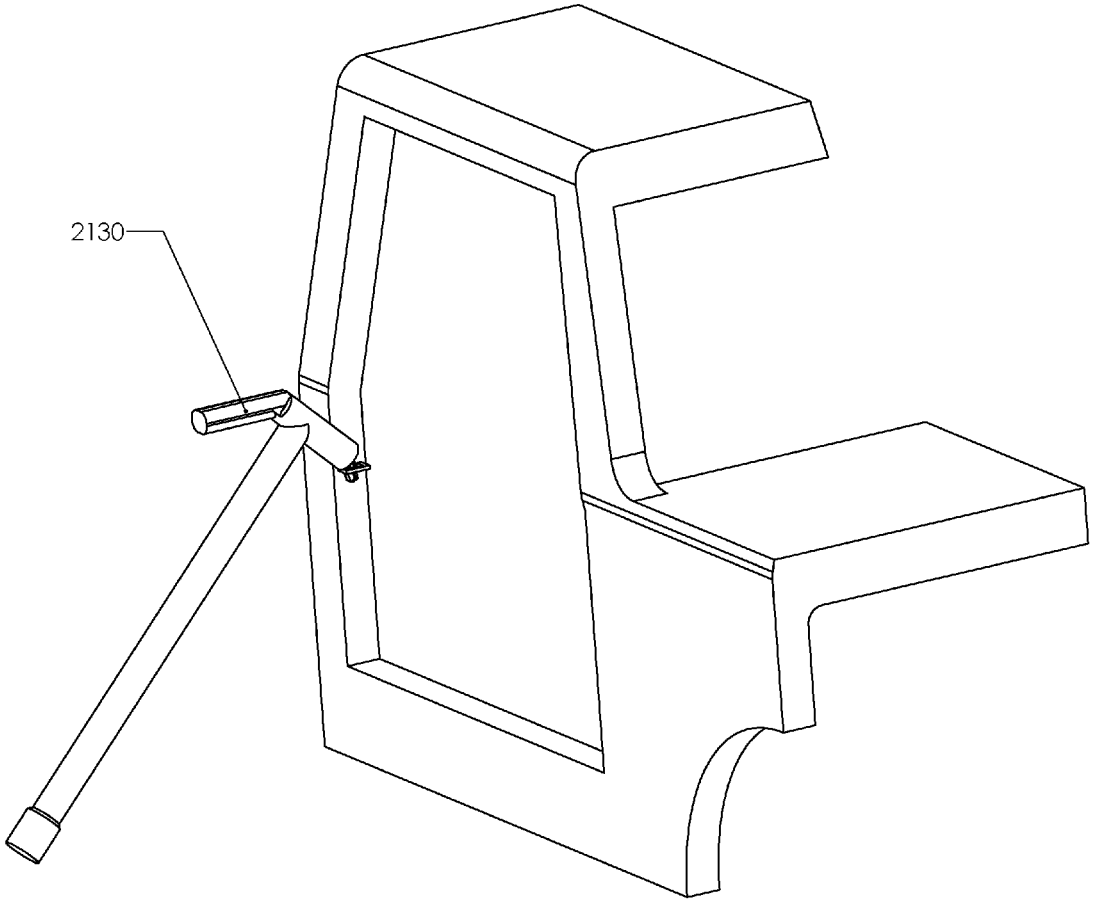
FIG. 6 shows a mobility device engaged upon the door striker of a car.

Referring now to FIG. 6, a mobility device 2000 is shown engaged upon the striker plate of an automobile door. In such a configuration, secondary grip 2130 is oriented to be conveniently grasped by the user upon exiting the vehicle.

Figure 5:
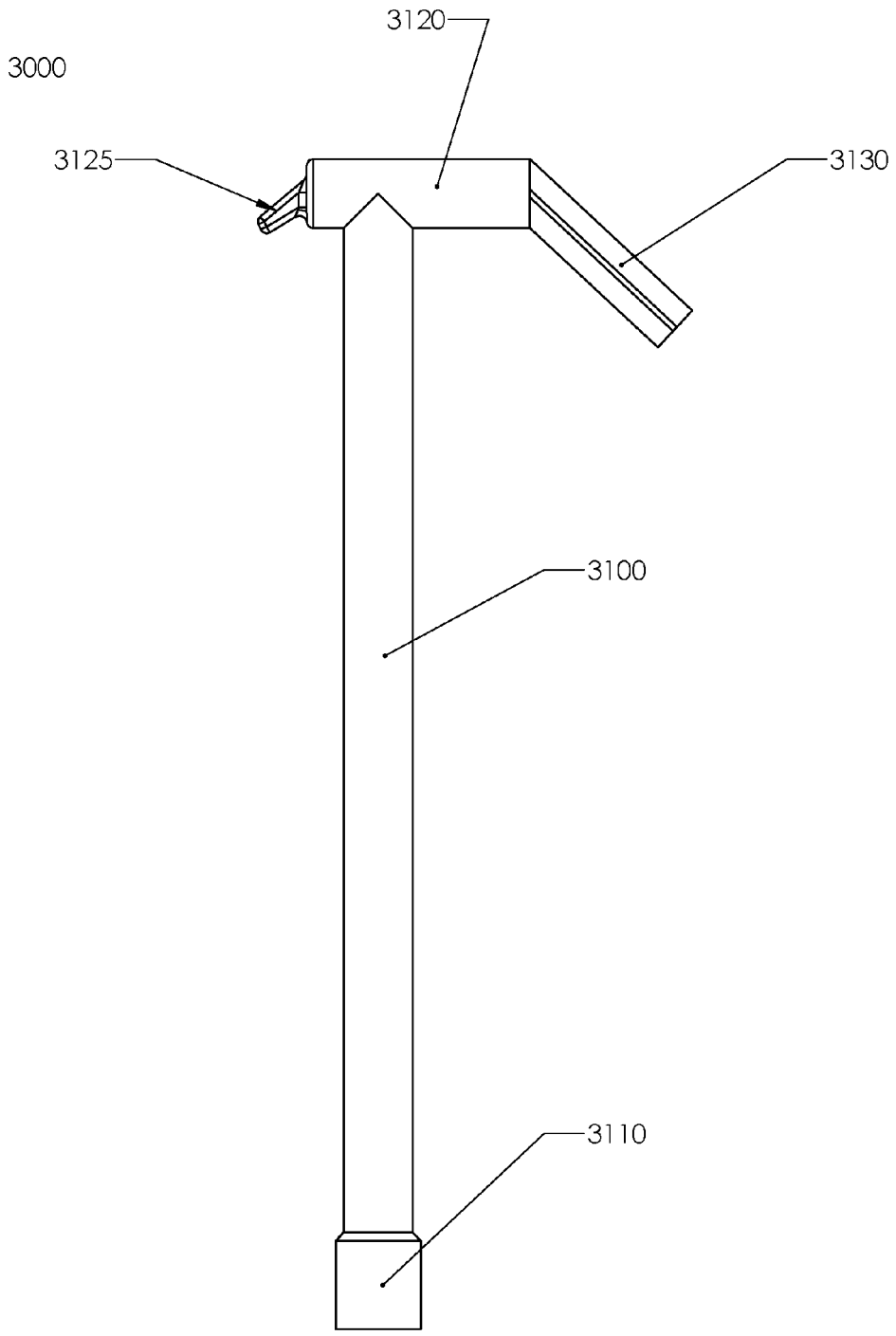
FIG. 5 shows a front view of a further embodiment of a mobility grip.

Referring now to FIG. 5, a further embodiment 3000 of a mobility device is shown. Moblity device 3000 is an improved walking cane similar to mobility device 1000 in that mobility device 3000 has a gripping portion 3120 disposed upon the cephalic-end portion of an elongated shaft 3100. There is a Contact pad 3110 disposed upon the caudal end portion of shaft 3100 selected from a material which provides grip and traction as pad 3110 is pressed against the ground/floor. There is an engagement tooth 3125 sized and shaped to be engaged upon the striker plate of an automobile door extending outward and caudally from primary grip 3120 and a secondary grip 3130 extending from proximal end portion of primary grip 3120. The long axis of secondary grip 3130 is disposed at an angle between 15 and 75 degrees downward from the long axis of primary grip 3120. If a user were shown in FIG. 5 holding mobility device 3000, the user would be facing towards the left edge of the page with their hand engaged about grip 3120 with tooth 3125 extending in distal direction away from the user and grip 2130 extending in proximal direction towards from the user.

Figure 7:
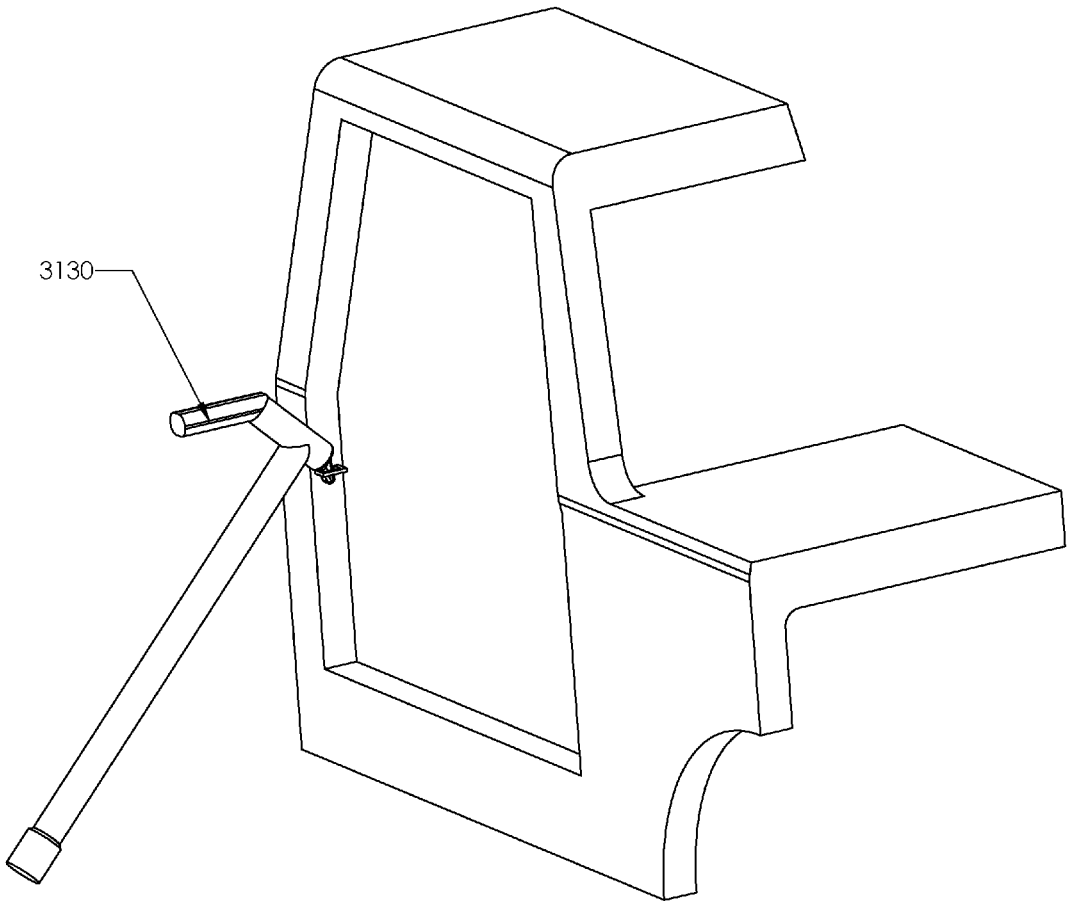
FIG. 7 shows a mobility device engaged upon the door striker of a car.

Referring now to FIG. 7, a mobility device 2000 is shown engaged upon the striker plate of an automobile door. In such a configuration, secondary grip 3130 is oriented to be conveniently grasped by the user upon exiting the vehicle.

There are further embodiments of the present disclosure, wherein a mobility grip similar to that of application No. 62/100,035 is pivotably coupled to the shaft of a walking cane, thereby defining a new improved walking cane.

Referring now to FIGS. 8, 8*a*, 9, 9*a*, and 10 together, an embodiment of a mobility grip is shown which is capable of being coupled to the door striker plate of an automobile.

There is an engagement tooth extending outward from the anterior portion of the grip with two teeth disposed thereupon with an angle theta therebetween. Theta is between 30 and 120 degrees and chosen such that when the tooth is engaged in the door striker plate of an automobile, the shaft of the cane is placed out of the way and optionally in contact with the ground. Although the teeth in the figures are shown as being paired mirror reflections of one another, there are further embodiments of the present disclosure where there is only a single tooth which is offset from normal by an angle zeta which is similarly chosen such that it is between 30 and 120 degrees and selected such that when the tooth is engaged in the door striker plate of an automobile, the shaft of the cane is placed out of the way of the user and optionally in contact with the ground. The respective teeth are sized and shaped to engage removably with the metal loop of an automobile striker plate. Example shapes and configurations of the tooth are disclosed at least by FIG. 2, FIG. 8, FIG. 9, FIG. 9*a*, FIG. 10, and the text of U.S. Pat. No. 6,340,189 granted on Jan. 22, 2002 to William Pordy which is hereby incorporated by reference in its entirety.

Figure 14:
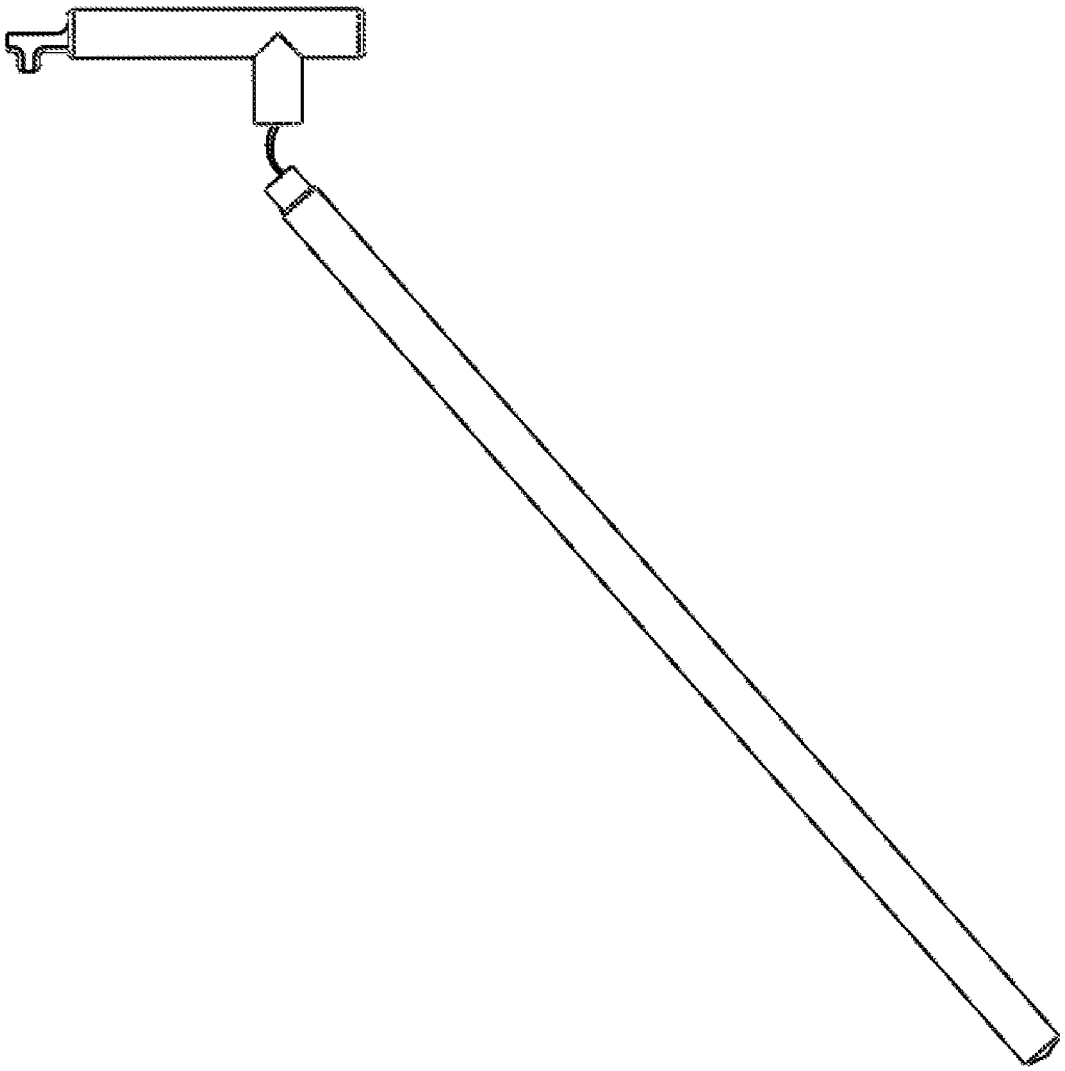
FIG. 14 shows a side view of a mobility device.
Figure 15:
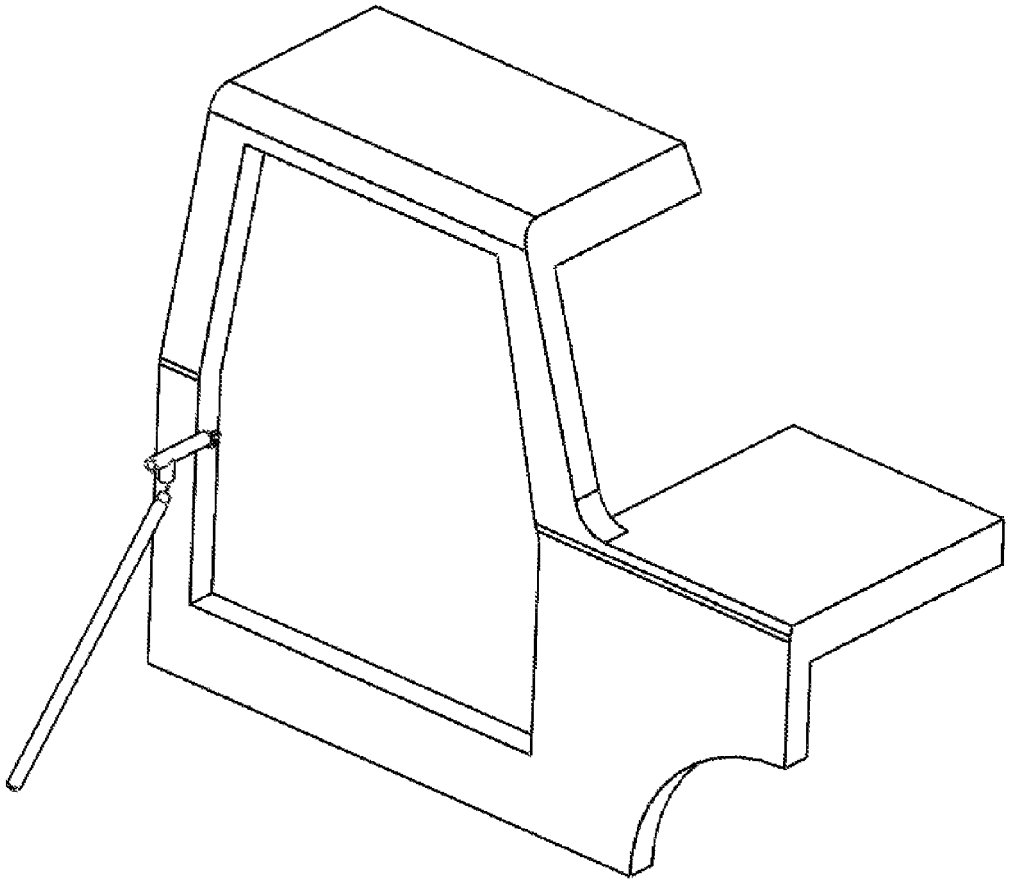
FIG. 15 shows a perspective view of a mobility device coupled to the door striker plate of a car.
Figure 16:
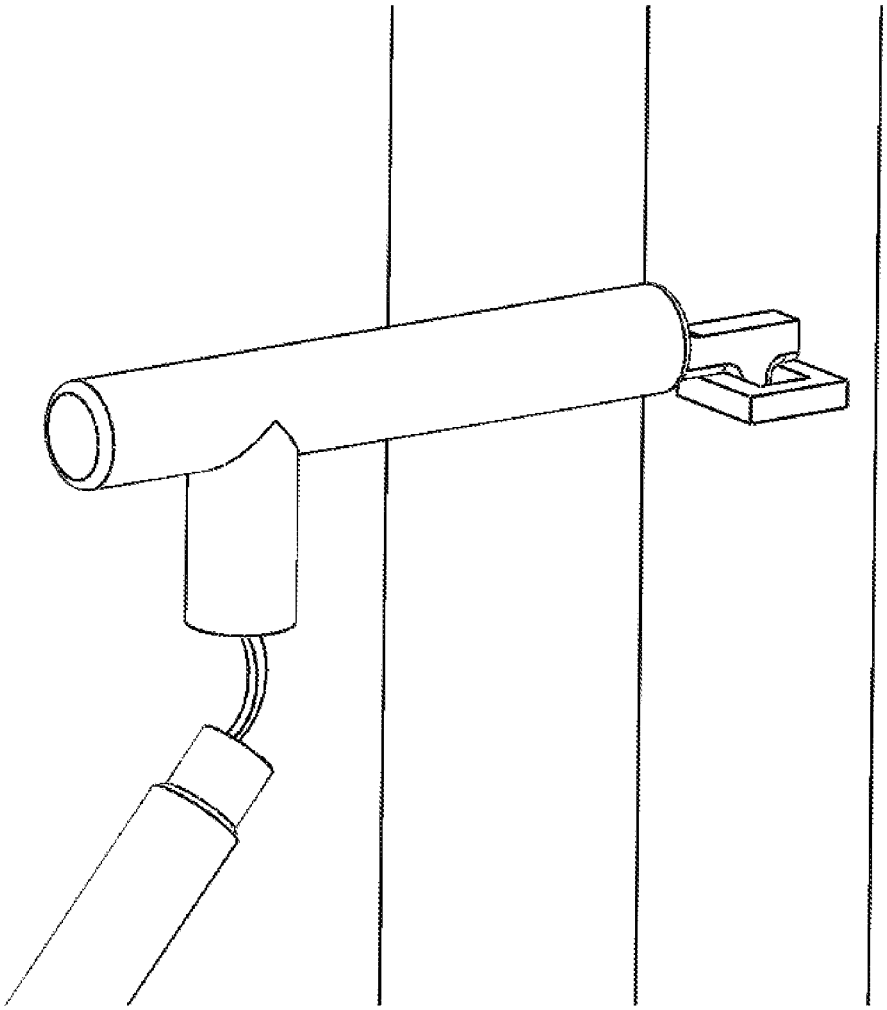
FIG. 16 shows an enlarged perspective view of a mobility device coupled to the door striker plate of a car.
Figure 17:
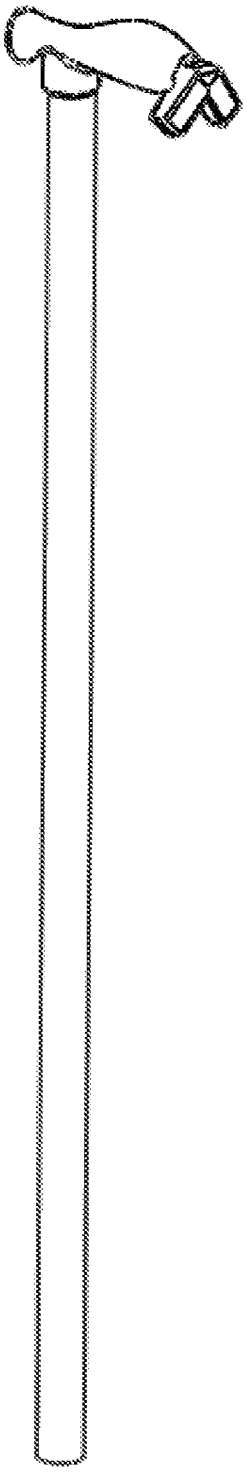
FIG. 17 shows a perspective view of a mobility device.
Figure 18:
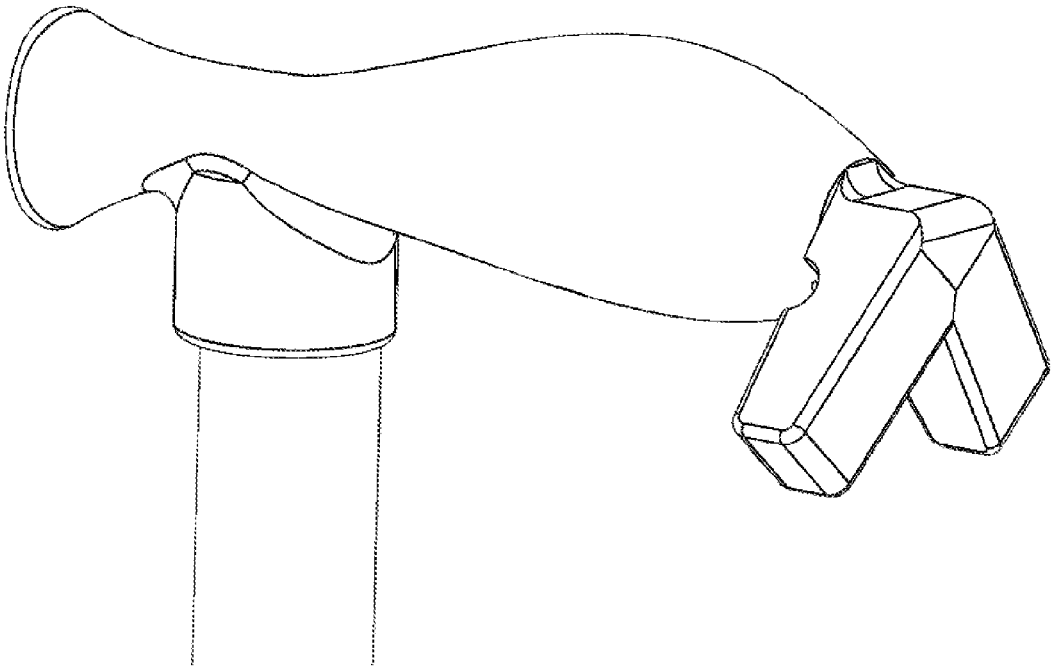
FIG. 18 shows an enlarged perspective view of a mobility device.
Figure 19:
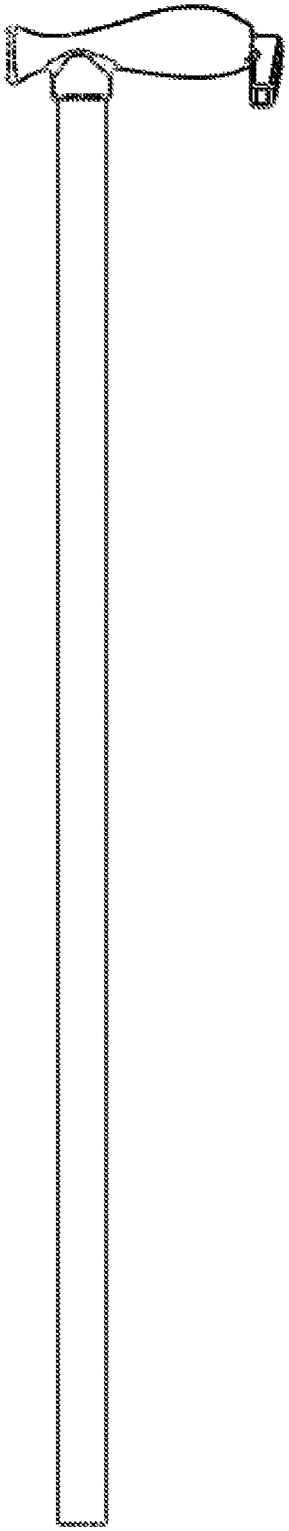
FIG. 19 shows a side view of a mobility device.
Figure 20:
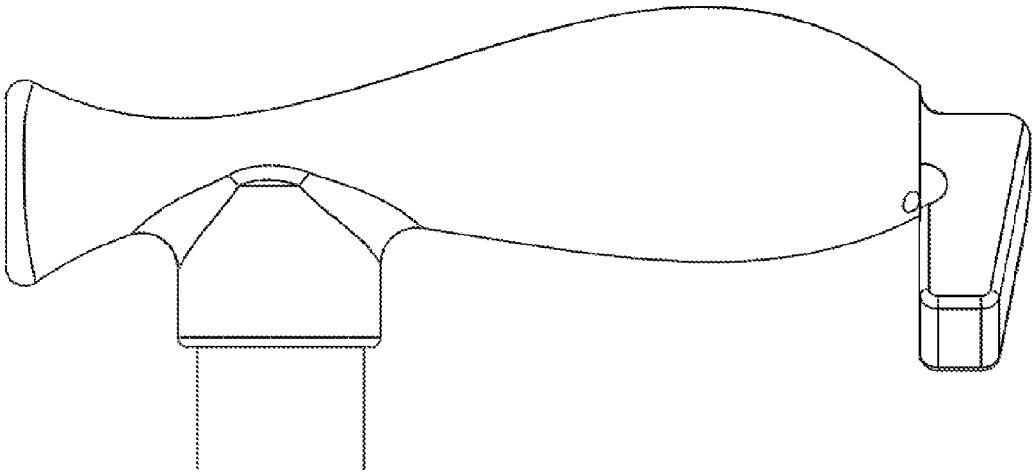
FIG. 20 shows an enlarged side view of a mobility device.
Figure 21:
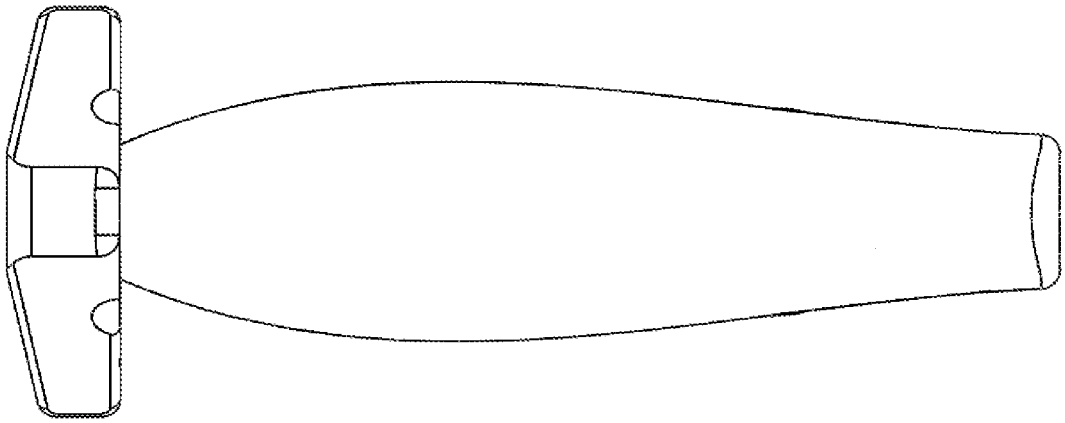
FIG. 21 shows a top view of a mobility device.

Referring now to FIGS. 11, 12, 13, 14, and 15 together, a further embodiment of a mobility grip is shown, wherein a tooth extends normally from the handle portion of a cane. At least a portion of the shaft is detachable from the handle by means of an elastic band extending therethrough, with the cephalic portion of the shaft having a narrowed diameter relative to the remainder of the shaft, wherein the cephalic portion of the shaft is sized and shaped to be engaged within a complementary portion of the handle. In such an arrangement, the shaft and be temporarily detached from the handle as shown in FIGS. 14, 15, and 16 such that the shaft can be swung away from the handle so as not to interfere with the ground when the tooth is engaged upon the loop of a door striker plate. This "swinging away" action may similarly be achieved by means of a hinge or pivot which temporarily changes the angle of incidence between the shaft and grip. There are further embodiments of the present disclosure wherein the overall length of the shaft may be reduced by a telescoping action.

There are further embodiments of the present disclosure, where the teeth of the preceding embodiments are capable of folding into the handle so as not to protrude when not in use. There are further still embodiments of the present disclosure wherein there is a sheath which covers the teeth when they are not in use.

Referring now to FIGS. 17, 18, 19, 20, and 21 together, a further embodiment of a mobility grip is shown having contoured handle disposed near the cephalic end portion thereof and a pair of opposing extending in a caudal-facing "V" from the proximal end of the grip. There is a vertical cane shaft extending caudally from the grip as well. There are cutaways disposed upon the distal faces of the "V" sized and shaped to accommodate a car striker plate therein.

With returning reference to FIG. 4, a mobility device 2000 is shown in an exemplary "vertical" or "walking" state with grips 2130 and 2120 together comprising one embodiment of a "handle." Similarly, with returning reference to FIG. 10, a mobility device is shown in a "vertical" or "walking" state. With returning reference to FIGS. 8 and 8*a* together, a mobility device is shown in an exemplary "diagonal" state. With returning reference to FIG. 6, a mobility device 2000 is shown in an exemplary "diagonal" state. With returning reference to FIGS. 14 and 15 together, a mobility device is shown in an "automotive" state.

Figure 8:
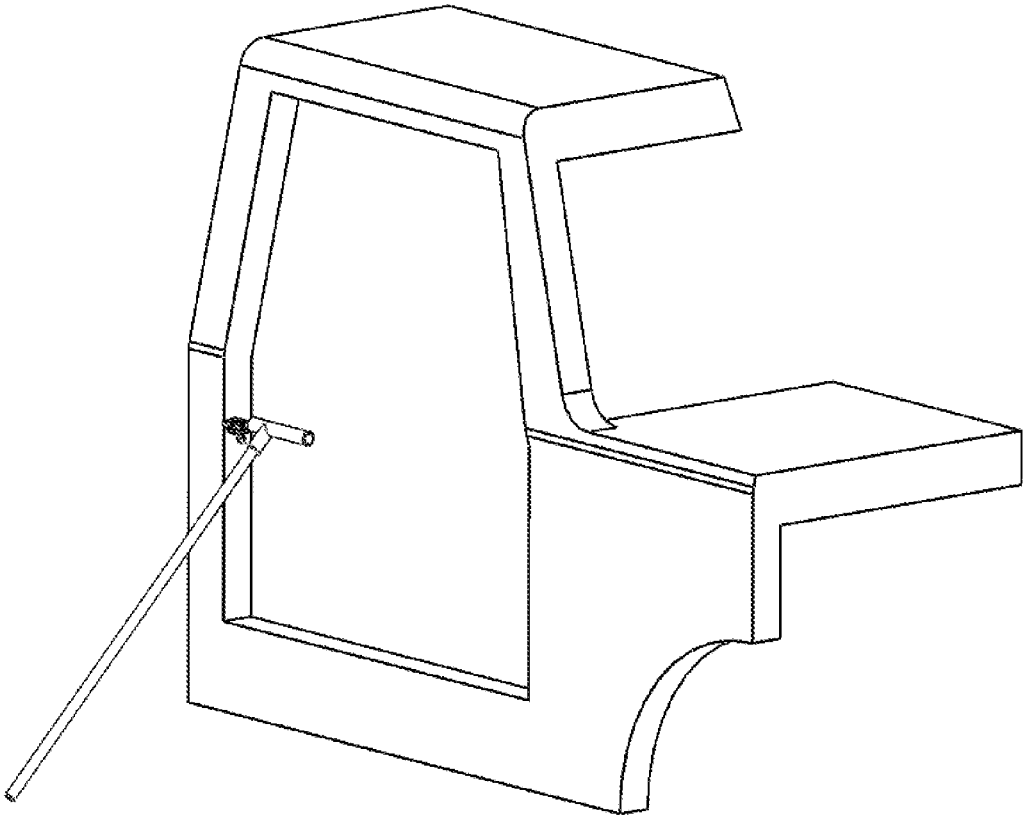
FIG. 8 shows a mobility device engaged upon the door striker of a car.
Figure 8A:
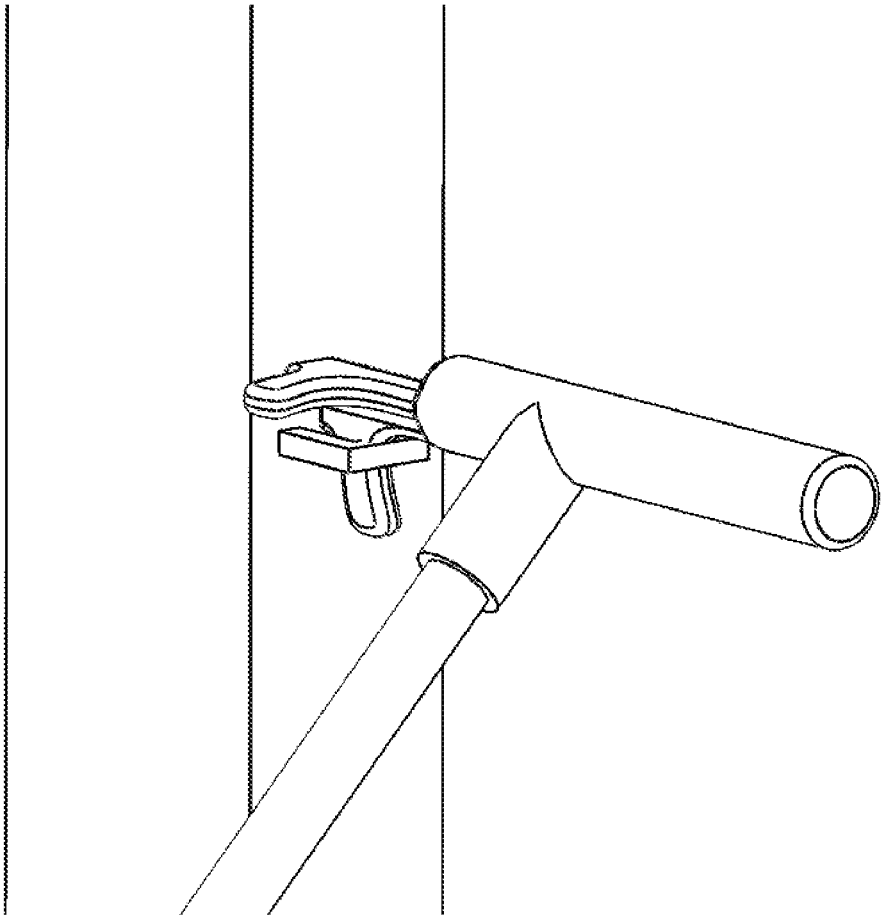
FIG. 8*a* shows an enlarged view of a mobility device engaged upon the door striker of a car.
Figure 9:
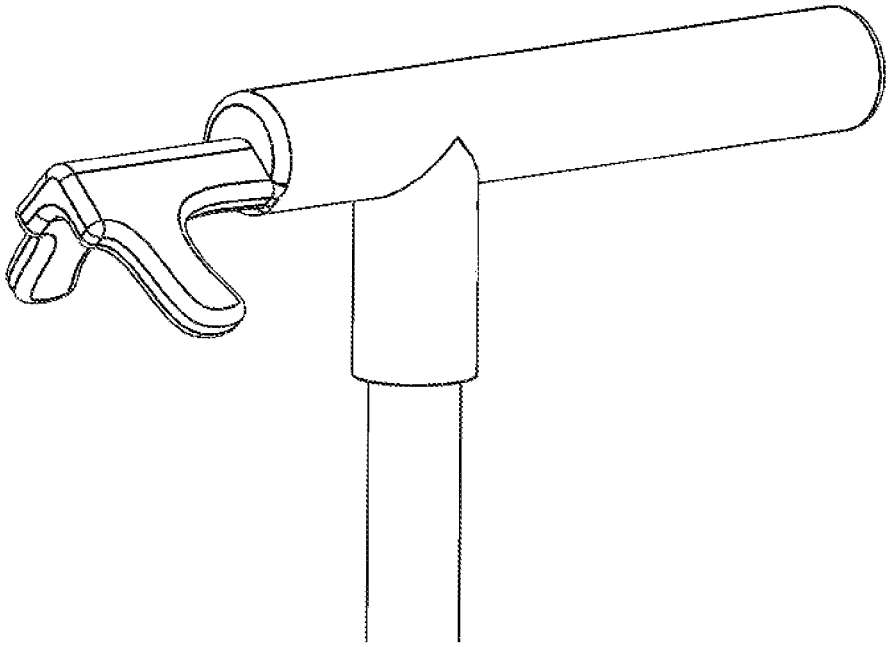
FIG. 9 shows a close-up isometric view of a mobility device.
Figure 9A:
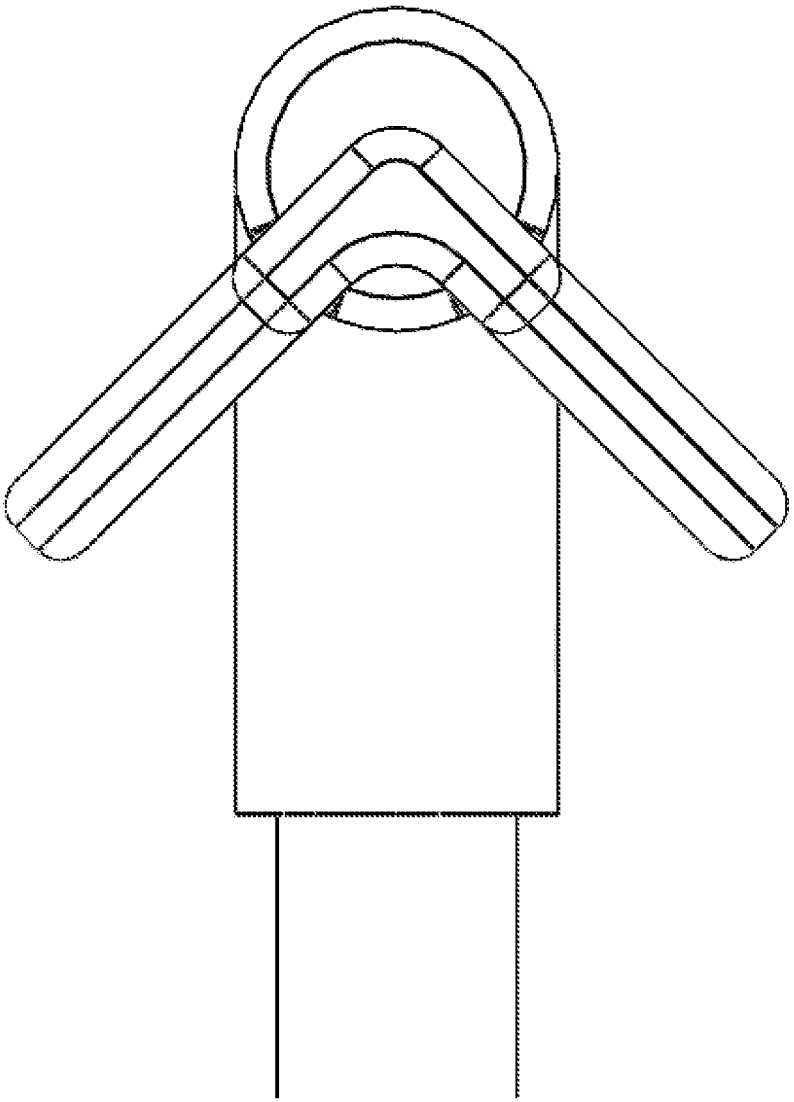
FIG. 9*a* shows a close-up front view of a mobility device.
Figure 10:
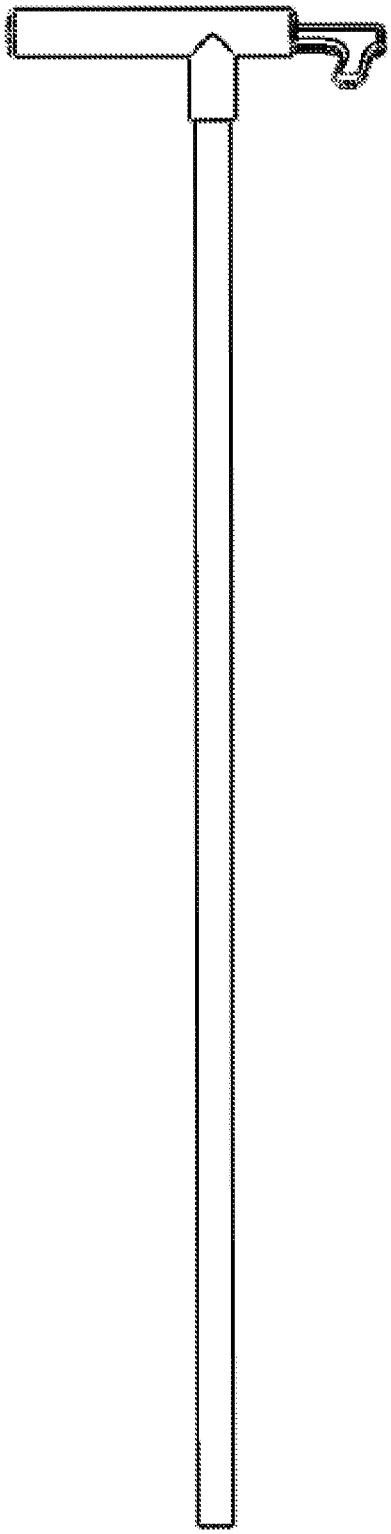
FIG. 10 shows a side view of a mobility device.
Figure 11:
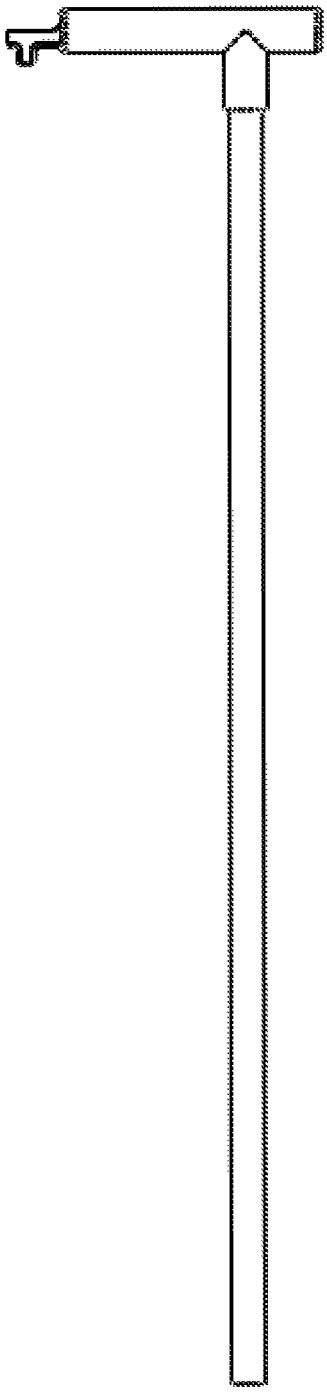
FIG. 11 shows a side view of a mobility device.
Figure 12:
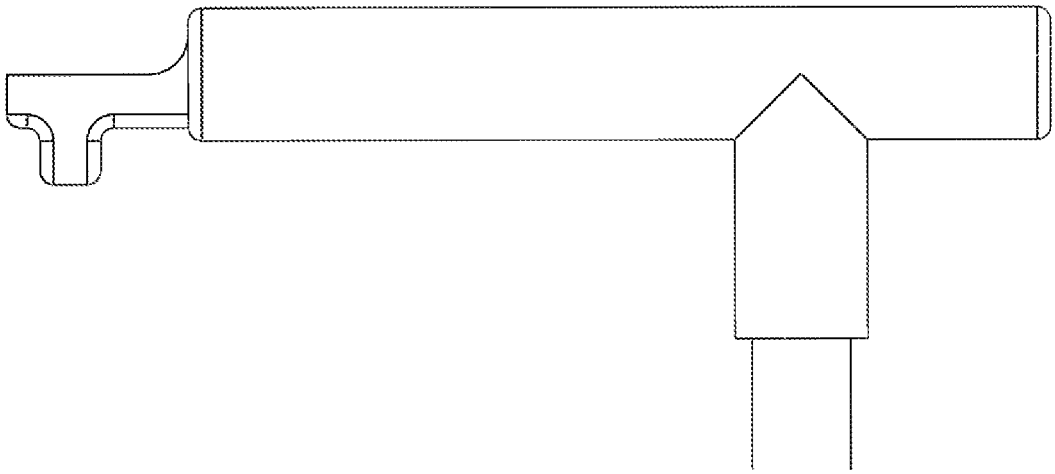
FIG. 12 shows an enlarged side view of a mobility device.
Figure 13:
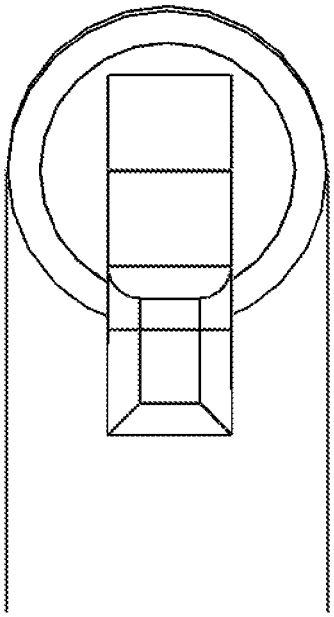
FIG. 13 shows a front view of a mobility device.

An exemplary method of using a mobility grip as shown in FIGS. 8 through 10 will now be described. A mobility grip as shown in FIG. 10 may be used as a conventional cane by a user who grasps the horizontal handle with their hand and braces the vertical shaft against the ground. When a user wishes to use the mobility grip to enter or exit a vehicle, he may engage the teeth of the device into the door striker plate of an automobile as shown in FIGS. 8 and 8*a*, thereby orienting the handle of the device into such a condition where it may be used as a handle aiding egress from a vehicle much in the same manner as that described by Pordy. When the user no longer wishes to use the mobility grip to enter or exit a vehicle, he me lift it vertically out from engagement with the striker plate and thereby continue using the device as he would a conventional cane.

Figure 22:
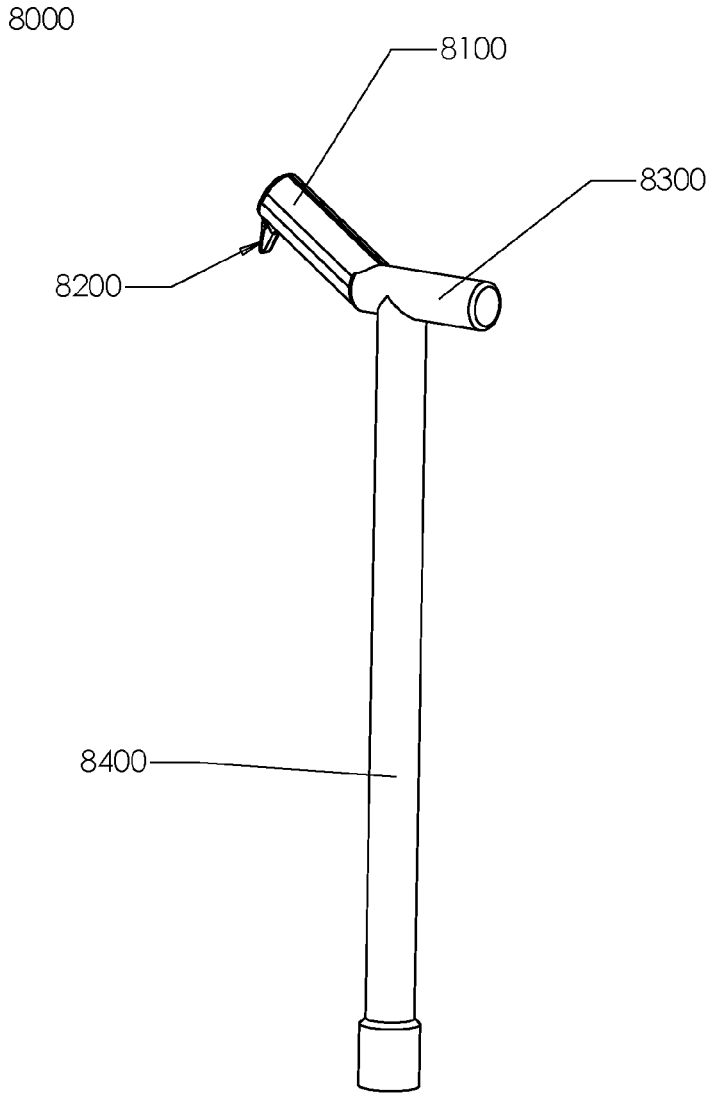
FIG. 22 shows a perspective view of an exemplary embodiment of a mobility device.

Referring now to FIG. 22, an exemplary embodiment 8000 of a mobility aide is shown wherein there is a first grip 8100 sized and shaped to be grasped by a user, and elongated shaft 8400 sized and shaped to provide operative support for the first grip, a secondary grip 8300 extending at an angle from the first grip, and an engagement tooth 8200 extending from the first grip with the engagement tooth being sized and shaped to be removably coupled to the metal loop of an automobile striker plate.

Although the present invention has been described in the preceding text with respect to specific structures and features, these are intended to illustrate by way of non-limiting example various ways of implementing the claims which are appended below.

What is claimed is:

1. A mobility device comprising;

a. a cane having a handle comprising a first grip near a top end portion of the cane with the first grip being a portion of the handle sized and shaped to be comfortably grasped by the hand of a user with the first grip having a long axis extending therethrough and an elongated shaft extending vertically from the ground to the handle with the shaft providing operative support between the user's hand and the ground when used in a first "vertical" state, b. an engagement tooth being an elongated and rigid member a portion of whose outside cross section is sized and shaped to be firmly and removably coupled to the inside cross section of the metal loop of an automobile striker plate, the engagement tooth coupled to the handle wherein upon insertion of the tooth into an automobile striker plate thereby defining a second, "diagonal" state, the long axis of the first grip extends in a substantially parallel direction to the ground and provides firm resistance when urged downward by the hand of a user, the elongated shaft extends in a diagonal direction to the ground, and the tooth extends in a substantially downward direction towards the ground.

2. The mobility device of claim 1, wherein there is an elongated secondary grip coupled to the handle sized and shaped to be grasped by the hand of a user, with the secondary grip having a long axis at an angle theta between 15 and 45 degrees from the long axis of the first grip.

3. The mobility device of claim 2, wherein the secondary grip extends outward from the elongated shaft of the cane.

4. The mobility device of claim 2, wherein the secondary grip extends outward from the first grip.

5. The mobility device of claim 2, wherein the tooth extends in a substantially downward direction from the secondary grip when the device is in a "vertical" state.

6. The mobility device of claim 1, wherein there is a secondary grip extending from the first grip which is angled relative to the first grip so that the secondary grip will be substantially parallel to the ground when the tooth is engaged in the door striker of an average height automobile.

7. The mobility device of claim 1, wherein the tooth extends in a substantially caudal direction from the first grip.

8. The mobility device of claim 1, wherein the tooth extends in a substantially downward direction from the secondary grip when the device is in a "diagonal" state.

9. The mobility device of claim 1, wherein the coupling between the engagement tooth and the cane is rigid.

10. The mobility device of claim 1, wherein the engagement tooth is oriented at an angle theta between 30 and 120 degrees from the long axis of the shaft of the cane.

11. The mobility device of claim 10, wherein the angle of the shaft of the cane relative to the grip and the tooth may be temporarily changed by means of a joint mediated by one of an elastic cord or a hinging pivot.

12. The mobility device of claim 1, wherein there are two substantially mirrored engagement teeth wherein they are mirrored about a plane that intersects the long axis of the first grip.

13. The mobility grip of claim 1, wherein the tooth extends in a substantially caudal direction from the grip.

14. A mobility device comprising;

a. a cane having a handle comprising a first grip near a top end portion thereof with the first grip being sized and shaped to be comfortably grasped by the hand of a user and an elongated shaft extending vertically from the grip wherein the shaft has a foot portion at the end opposite the handle with the shaft providing operative support via the foot between the user's hand and the ground in a first "walking" configuration;

b. an engagement tooth being an elongated and rigid member a portion of whose outside cross section is sized and shaped to be firmly and removably coupled to the inside cross section of the metal loop of an automobile striker plate, the engagement tooth coupled to the handle;

c. a mechanical coupler disposed upon the shaft which reduces the vertical distance between the foot portion and the handle, thereby defining a second, "automobile" configuration such that when the device is configured in an "automobile" configuration and upon insertion of the tooth into the metal loop of an automobile striker plate, the first grip extends in a substantially parallel direction to the ground and provides firm resistance when urged downward by the hand of a user, the tooth extends in a substantially downward direction towards the ground, and the vertical distance between the foot and the first grip is substantially reduced relative to what the vertical distance was in the "walking" configuration so that the foot does not interfere with said insertion.

* * * * *